US011215179B2

(12) United States Patent
Santarossa

(10) Patent No.: US 11,215,179 B2
(45) Date of Patent: Jan. 4, 2022

(54) VOLUMETRIC COMPRESSOR WITH LUBRICANT COLLECTION DEVICE

(71) Applicant: JUROP S.P.A., Azzano Decimo (IT)

(72) Inventor: Danilo Santarossa, Azzano Decimo (IT)

(73) Assignee: JUROP S.P.A., Azzano Decimo (IT)

( * ) Notice: Subject to any disclaimer, the term of this patent is extended or adjusted under 35 U.S.C. 154(b) by 0 days.

(21) Appl. No.: 16/640,451

(22) PCT Filed: Aug. 27, 2018

(86) PCT No.: PCT/IB2018/056474
§ 371 (c)(1),
(2) Date: Feb. 20, 2020

(87) PCT Pub. No.: WO2019/043546
PCT Pub. Date: Mar. 7, 2019

(65) Prior Publication Data

US 2020/0208633 A1 Jul. 2, 2020

(30) Foreign Application Priority Data

Aug. 28, 2017 (IT) ..... 102017000096517

(51) Int. Cl.
*F04C 18/12* (2006.01)
*F04C 29/02* (2006.01)

(52) U.S. Cl.
CPC ..... *F04C 18/126* (2013.01); *F04C 29/02* (2013.01); *F04C 2240/50* (2013.01)

(58) Field of Classification Search
CPC .... F04C 29/0007; F04C 29/02; F04C 29/028; F04C 18/12; F04C 18/126; F04C 2240/50; F01C 21/007
See application file for complete search history.

(56) References Cited

U.S. PATENT DOCUMENTS 5,312,192 A * 5/1994 Shimuzu ..... F16C 33/6659 384/471
7,690,482 B2 * 4/2010 Shoulders ..... F01C 21/02 184/6.16
8,858,204 B2 * 10/2014 Crochet ..... F01C 19/005 418/83
2016/0369800 A1 * 12/2016 Santarossa ..... F04C 18/126
2016/0369803 A1 * 12/2016 Bessel ..... F04C 29/12
2016/0369804 A1 * 12/2016 Santarossa ..... F04C 29/124
2017/0058846 A1 * 3/2017 Heaps ..... F04C 25/02
2018/0230999 A1 * 8/2018 Santarossa ..... F04C 29/0035

* cited by examiner

*Primary Examiner* — Audrey B. Walter
*Assistant Examiner* — Dapinder Singh
(74) *Attorney, Agent, or Firm* — Abelman, Frayne & Schwab

(57) ABSTRACT

The invention relates to a volumetric compressor (100) including a container (51) for collecting the lubricant moved by an oil distribution disc (1). The compressor (100) further comprises at least two lubricant distribution channels (52), in which each lubricant distribution channel (52) extends from the collecting container (51) so that during operation, the lubricating oil flowing along the channel itself reaches a lubrication opening (82) of a lubrication duct (81) for a rolling bearing (90) of a rotor (80', 80"). The lubrication opening (82) is arranged at a lower level with respect to the container (51).

11 Claims, 5 Drawing Sheets

VOLUMETRIC COMPRESSOR WITH LUBRICANT COLLECTION DEVICE

CROSS-REFERENCE TO RELATED APPLICATIONS

This application claims benefit to PCT application no. PCT/IB2018/056474, filed Aug. 27, 2018, which claims priority to Italian application no. IT 102017000096517, filed Aug. 28, 2017, the content of which are incorporated by reference in their entireties.

FIELD OF THE INVENTION

The present invention falls in the field of manufacturing volumetric compressors. In particular, the invention relates to a volumetric lobe compressor comprising a device for collecting the lubricating oil which allows the use of the volumetric compressor also at low rotational speeds.

BACKGROUND ART

A volumetric compressor, for example like that described in WO 2017/021941, typically comprises a body defining a chamber which accommodates two straight or helical lobe rotors. The body is closed at the ends by two longitudinally opposed heads, to which a cover acting as guard is restrained. Rolling bearings that carry the rotors, thus allowing the rotation thereof with respect to the body, are positioned at the heads. The lubrication of the heads and of said bearings in particular, is ensured by a lubricant bath in the volume comprised between each head and the related cover.

A transmission mechanism which allows the rotation of the lobes, is positioned at one head. Such a mechanism is operated through a shaft connected to an external motor. The transmission mechanism is partially positioned in the lubricant bath. Thus, the movement of the gears is sufficient to bring the oil at the related bearings.

An oil distribution disc typically is provided for the lubrication of the other head. Such a disc draws in the lubricant bath and distributes the lubricant inside the guard; part thereof reaches the rolling bearings supporting the rotors. The oil distribution disc is integrally fastened at the end of one of the rotors and rotates integrally therewith about a respective rotation axis. It has been noted that for medium-to-high rotation speeds (that is exceeding 700 rpm), the rotation of the disc is sufficient to ensure the lubrication of the bearings. Contrarily, for a low rotation speed (comprised for example between 200 and 700 rpm), the oil distribution disc does not ensure the lubrication. This aspect is a critical factor in terms of the potential use of volumetric volumes.

To obviate this drawback, external lubrication systems have been proposed, which allow the lubrication of the bearings regardless of the number of revolutions per minute of the rotors. Such systems provide an external lubrication circuit provided with a related circulating pump and configured to bring the lubricating oil at the rolling bearings. The main drawback of such systems lies in the complexity thereof, and therefore in the related cost. Moreover, these systems significantly increase the risk of breakdowns and therefore affect reliability. Finally, the lubrication systems also affect the overall volume of the compressor, thus being a critical factor when the space available for installation is limited.

It is therefore the main task of the present invention to provide a volumetric compressor capable of overcoming the above-described drawback. Within the scope of this task, it is a first object of the present invention to provide a volumetric compressor in which the lubrication of the rolling bearings is ensured also at low rotation speeds. It is another object of the present invention to provide a compressor in which such a lubrication is obtained without the aid of an external system, but by exploiting only the rotation of the lobe rotors. Not last, it is the object of the present invention to provide a volumetric compressor which is reliable and easy to be manufactured at competitive costs.

SUMMARY

The present invention relates to a volumetric compressor comprising a hollow main body defining an operating chamber for accommodating at least two lobe rotors rotating about respective substantially parallel rotation axes. The compressor further comprises at least one head provided at an end of said body and at least one cover fixed to said head so as to define a head volume comprised between said cover and said head, and susceptible during operation to accommodating a lubricant bath. The compressor according to the invention also comprises two rolling bearings, each rolling bearing being interposed between said head and a respective lobe rotor to allow the rotation of the respective lobe rotor about the respective rotation axis. Moreover, the compressor comprises at least two lubrication ducts, each of which extending between a lubrication opening in said head volume and a respective rolling bearing of said at least two rolling bearings.

According to the invention, the compressor includes an oil distribution disc accommodated in the head volume and integrally connected to one of said at least two lobe rotors. Such an oil distribution disc is susceptible to moving the lubricant of the lubricant bath, when put into rotation.

According to the invention, the compressor is also provided with a container for collecting said lubricant moved by said oil distribution disc; such a container is arranged at a higher height than that of the lubrication opening of the lubrication ducts. Moreover, the compressor comprises at least two distribution channels, each of which extends from the collecting container so that the lubricating oil, flowing along the same, reaches the lubrication opening of one of the corresponding lubrication ducts.

It has been shown that the collecting container and the two distribution channels ensure the lubrication of the rolling bearings also at low rotation speeds, in particular also at a rotation speed that is about one tenth of the maximum rotation speed allowed. This is obtained by exploiting only the rotation of the rotors, without the aid of an external system.

BRIEF DESCRIPTION OF THE DRAWINGS

Further features and advantages of the present invention will become more apparent from the following detailed description, provided by way of non-limiting example and illustrated in the accompanying drawings, in which.

The same numbers and the same letters in the figures identify the same elements or components.

DETAILED DESCRIPTION OF THE INVENTION

Figure 1:
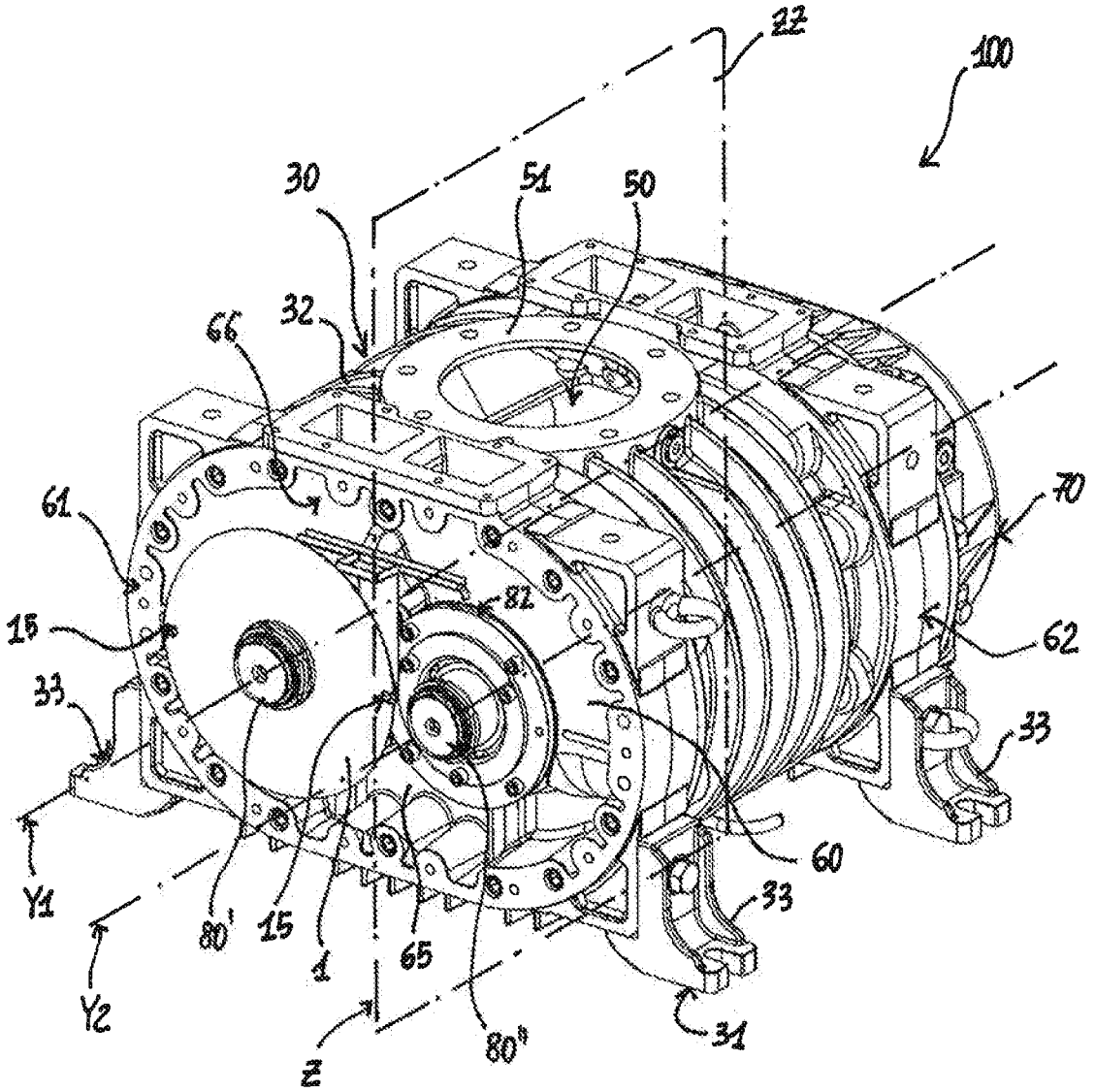
FIG. 1 is a partial axonometric view of a volumetric compressor according to the present invention.
Figure 2:
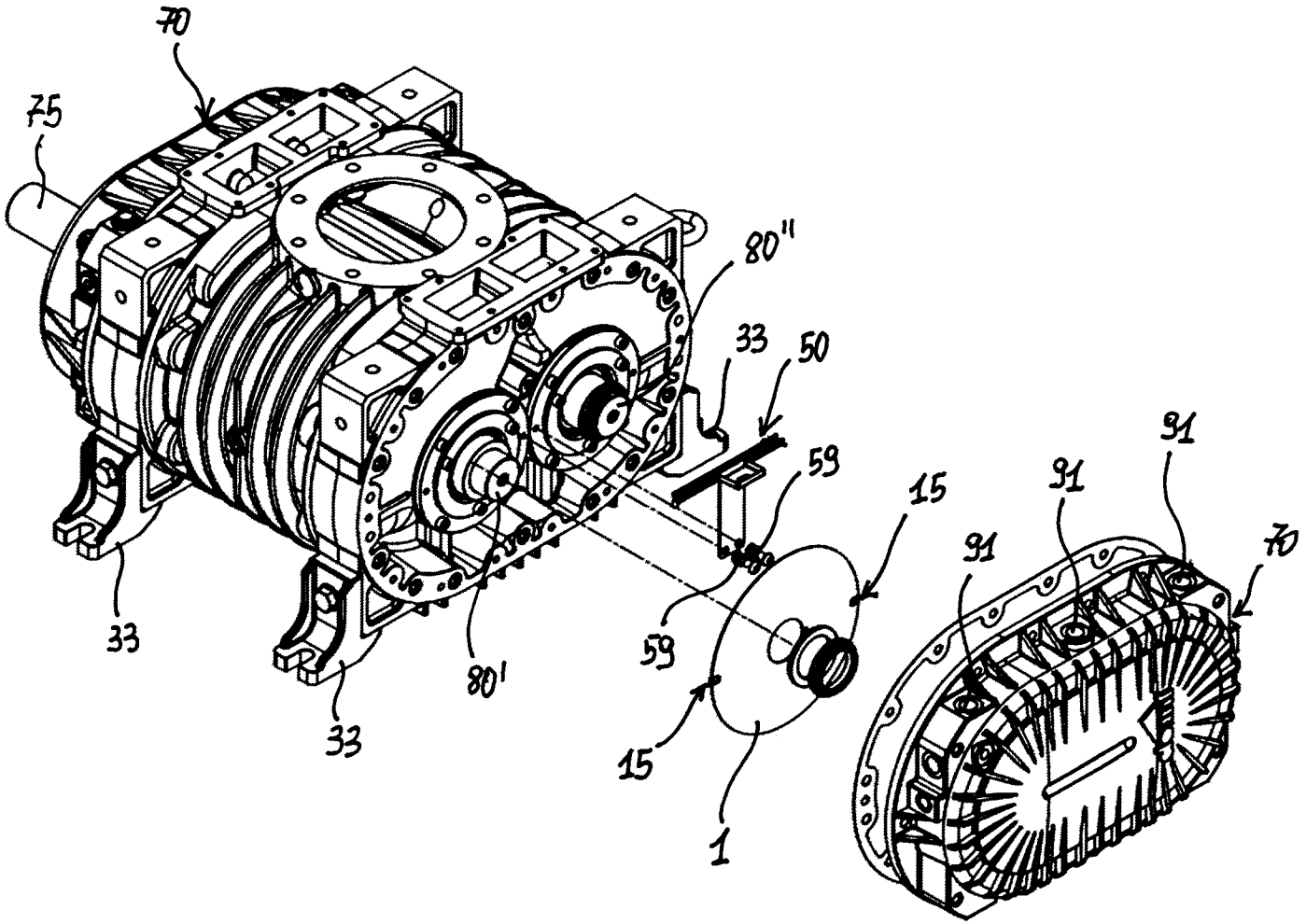
FIG. 2 is an exploded axonometric view of a volumetric compressor according to the present invention.

With reference to FIGS. 1 to 4, the volumetric compressor 100 according to the present invention comprises a main body 30 defining an operating chamber 50. Compressor 100 further comprises a first head 61 and a second head 62, on longitudinally opposed sides of the main body 30. The first head 61 and the second head 62 are connected to body 30, thus longitudinally delimiting chamber 50.

Compressor 100 comprises, in a direction orthogonal to the longitudinal extension thereof from one to the other of the heads 61, 62, a resting base 31 by means of which compressor 100 is restrained to an external support structure (not depicted because it is not an object of the present invention) and an opposed top 32. The resting base 31 is defined by two pairs of resting brackets 33, each pair being provided with a respective head 61, 62. It typically is provided for the resting base to be arranged according to an almost horizontal plane.

Body 30 also comprises a suction section 51, on the top 32 of compressor 100, and a discharge section (not shown in the accompanying drawings) of chamber 50. The suction section 51 and the discharge section are configured for the suction and discharge, respectively, of a working fluid to be compressed, e.g. air.

Compressor 100 further comprises two covers 70 fastened to the first head 61 and to the second head 62, respectively, so as to define two respective head volumes 60 comprised between the first head 61 and the respective cover 70 and between the second head 62 and the respective cover 70, respectively.

The head volumes 60 are susceptible to accommodating a lubricant bath during operation. During operation, i.e. when compressor 100 is restrained to the external support structure by resting on the resting base 31, each head volume 60 is divided between a bottom portion 65, closer to the resting base 31, which houses the lubricant bath, and an opposed top portion 66, closer to the top 32 of compressor 100.

The lubricant may be introduced in the head volume 60 through a plurality of openings 91 defined in cover 70, at the top 32 of compressor 100.

Compressor 100 comprises at least one pair of lobe rotors 80', 80". The lobes of the rotors 80', 80" are accommodated in chamber 50. The ends of the rotors 80', 80" protrude in the head volumes 60 from both the first head 61 and the second head 62. The rotors 80', 80" are carried at the heads 61, 62 by respective rolling bearings 90 so as to each rotate about a corresponding rotation axis Y1, Y2. The rotation axes Y1, Y2 are parallel to each other and define a center-plane Y1Y2 of compressor 100 which is substantially parallel to the resting base 31. With reference to the accompanying drawings, two rolling bearings 90 are interposed between the first head 61 and each of the lobe rotors 80', 80" to allow the rotation of the respective lobe rotor 80', 80" about the respective rotation axis Y1, Y2. Similarly, two rolling bearings 90 (not shown in the accompanying drawings) are interposed between the second head 62 and each of the lobe rotors 80', 80" to allow the rotation of the respective lobe rotor 80', 80" about the respective rotation axis Y1, Y2.

The operation of the pair of rotors 80', 80" for the compression of the working fluid is in itself known and conventional and therefore not described in further detail. One of the two heads 61, 62 accommodates a motion transmission mechanism connected to an external motor through a shaft 75 according to a principle in itself known. In the drawings, the head that accommodates said mechanism is indicated with reference numeral 62 and is opposite to the head indicated with reference numeral 61, hereinafter indicated also as "first head 61".

In particular, according to the invention, compressor 100 comprises two lubrication ducts 81, each of which extending between a lubrication opening 82 in the head volume 60 and a respective rolling bearing 90. The lubrication opening 82 is arranged in the top portion 66 of the head volume 60, facing towards the top 32 of compressor 100, i.e. on the opposite side with respect to the resting surface 31. During operation, the lubrication opening 82 of the lubrication duct 81 faces upwards, with the resting base arranged according to an almost horizontal plane. The lubrication opening 82 in essence depicts the inlet for the lubricating oil in the corresponding lubrication duct.

The drawings show a preferred but in any case non-limiting embodiment of the lubrication ducts 81. In particular, in the embodiment shown, the compressor 100 comprises two mounting flanges for each rotor 80', 80", at least for the first head 61. Each flange is used to fasten a rolling bearing 90 to the first head 61. In particular, each lubrication duct 81 is defined between the mounting flange and the first head 61.

Namely in the embodiment shown, each mounting flange consists of two bushings 21, 22. In particular, the first bushing 21 comprises a hollow cylindrical body 42, which is coaxial and external with respect to the respective rolling bearing 90. The first bushing 21 also comprises a first shoulder 41 having smaller diameter with respect to the cylindrical body 42. The first shoulder 41 defines an abutment surface for a first axial end 90*a* of the rolling bearing 90, i.e. for the axial end of the rolling bearing 90 facing the chamber 50 of compressor 100.

The first bushing 21 also comprises a second shoulder 43 having larger diameter with respect to the cylindrical body 42, and axially opposed to the first shoulder 41, the second shoulder 43 therefore facing the respective head volume 60. The second shoulder 43 can be used to fasten the first bushing 21 to the first head 61 by means of a plurality of screws 45 (four screws 45 in the embodiment of the accompanying drawings) uniformly distributed about the respective rotation axis Y1, Y2 of the corresponding rotor.

The second bushing 22 comprises a hollow and coaxial cylindrical body 44 which acts as abutment for the second axial end 90*b* of the rolling bearing 90, which is opposed to the first axial end 90*a*. The second bushing 22 comprises a third shoulder 46 having larger diameter with respect to the cylindrical body 44, on the axially opposite side with respect to the respective rolling bearing 90. The third shoulder 46 can be used to fasten the second bushing 21 to the second shoulder 43 of the respective first bushing 21 by means of a plurality of screws 47 (three screws 47 in the embodiment of the accompanying drawings) uniformly distributed about the respective rotation axis Y1, Y2.

Figure 4:
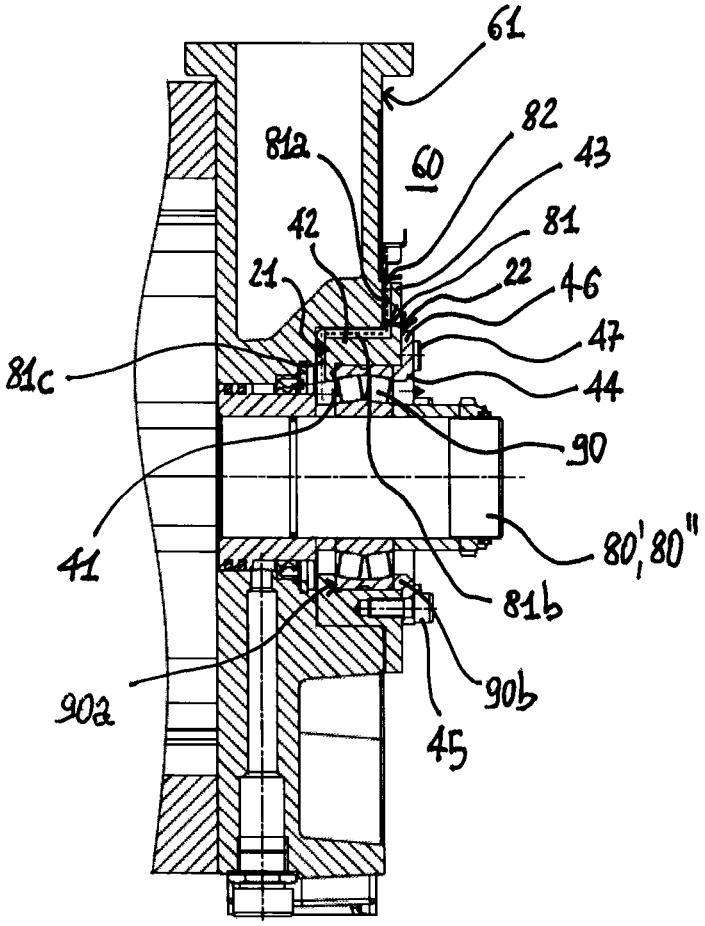
FIG. 4 is a sectional view according to line IV-IV in FIG. 3.

As shown in FIG. 4, each lubrication duct 81 extends between the first bushing 21 of the corresponding mounting flange and the first head 61. In particular, a first stretch 81A of the lubrication duct 81 is defined between the second shoulder 43 of the first bushing 21 and head 61; a second stretch 81B, communicating with the first stretch 81A, is defined between the cylindrical body 42 and a cylindrical seat of head 61 (in which the cylindrical body 42 itself is accommodated), and a third stretch 81C, communicating with the second stretch 81B, is defined between a more inner surface of the first shoulder 41, opposite to the abutment surface of the bearing, and a corresponding surface of head 61. The above-indicated stretches 81A, 81B, 81C may be defined by respective grooves made along the walls 41, 42, 43 of bushing 21. More accurately, it is worth noting how the lubrication opening 82 in essence defines the inlet of the lubricating oil in the first stretch 81A.

In an alternative embodiment not shown in the drawings, the related lubrication duct for at least one mounting flange could be defined between the two bushings 21, 22, and namely between the third shoulder 46 of the second bushing 22 and the second shoulder 43 of the first bushing 21 defined above.

Compressor 100 according to the invention also comprises an oil distribution disc 1 accommodated in the head volume 60 of the first head 61 and integrally connected to one of the two lobe rotors 80', 80" (in particular, to the lobe rotor 80' according to the variant of the accompanying drawings). The oil distribution disc 1 is susceptible to moving the lubricant of the lubricant bath from the bottom portion 65 towards the top portion 66 when put into rotation together with the lobe rotor 80' to which it is restrained.

Preferably, the oil distributing action of disc 1 is obtained by means of a plurality of notches 15 (two diametrically arranged notches 15 in the embodiment of the accompanying drawings) provided along the outer edge of the oil distribution disc 1. The notches 15 may be obtained by compressing the edge or may be defined by radial recesses. The notches 15 allow the drawing of the oil from the bottom portion 65.

At high speeds, in particular for rotation speeds exceeding 2000 rpm, the oil distribution disc 1 rotates by distributing the lubricant in all directions, and therefore also towards the lubrication opening 82 of the lubrication duct 81. At medium-to-high speeds (for example, above 700 rpm), such a mechanism is sufficient to ensure the lubrication of the rolling bearings 90.

Figure 3:
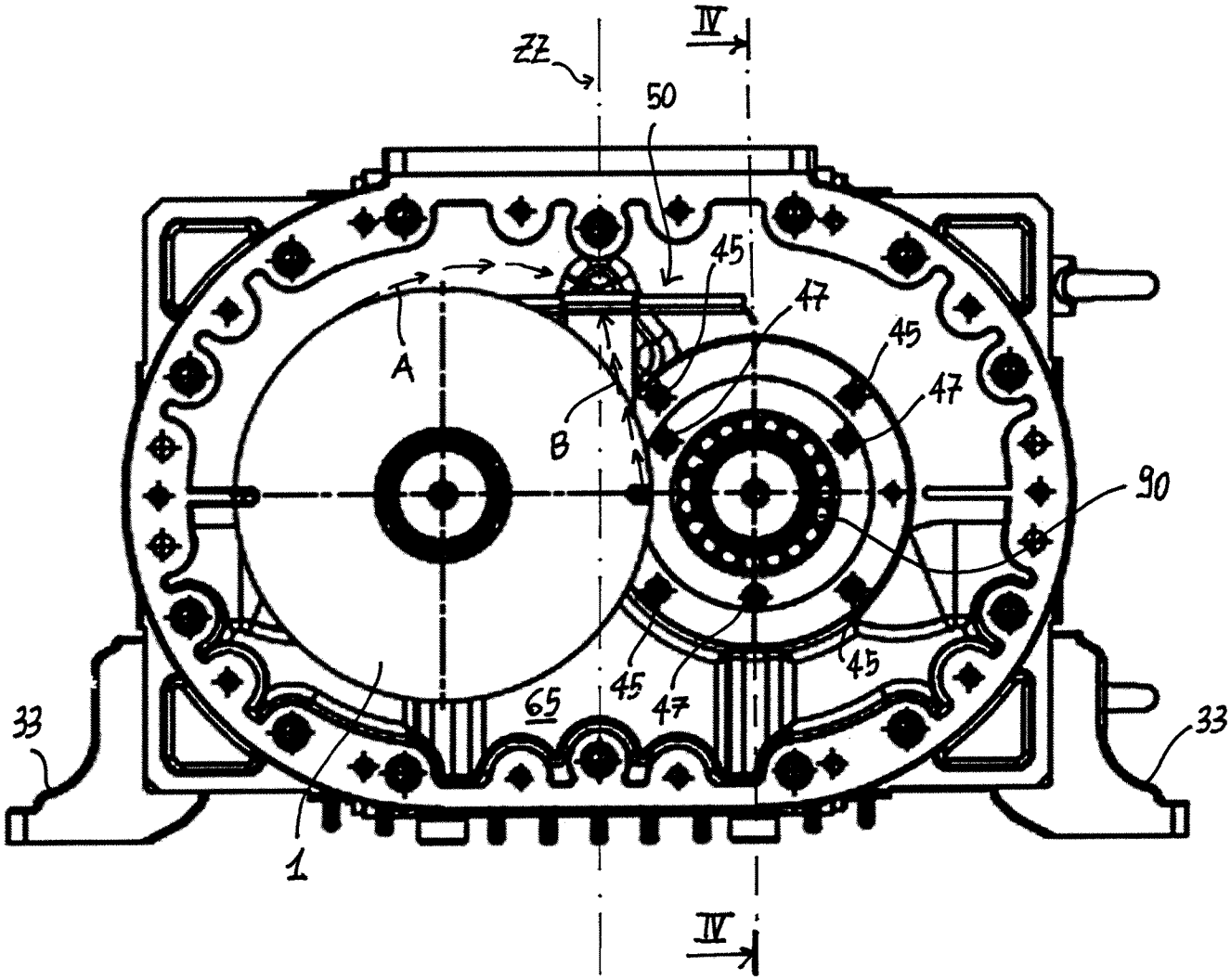
FIG. 3 is a front view of the volumetric compressor in FIG. 1.

At low speeds (for example, between 250 and 700 rpm) and with reference to FIG. 3, the lubricant indicatively follows the trajectory A or B indicated in FIG. 3 when the oil distribution disc 1 rotates in the clockwise or anticlockwise direction, respectively.

Such trajectories A and B intersect in an intermediate area of the top portion 66 of the head volume 60 between the rotation axes Y1, Y2.

Figure 5:
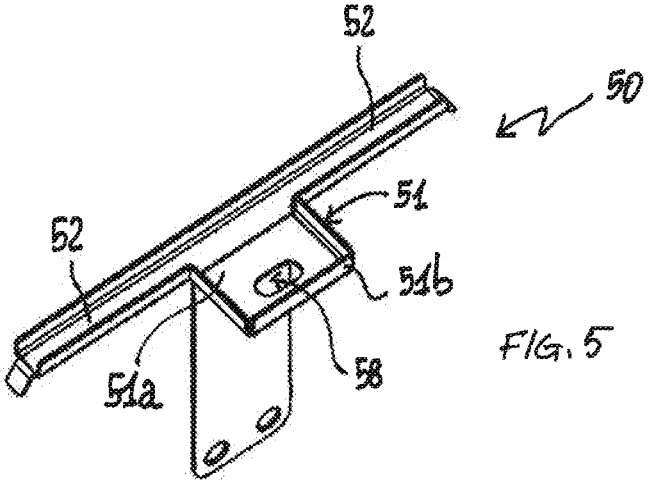
FIG. 5 is an axonometric view of a lubricant collection device according to the present invention, comprised in the volumetric compressor of FIGS. 1 and 2.
Figure 6:
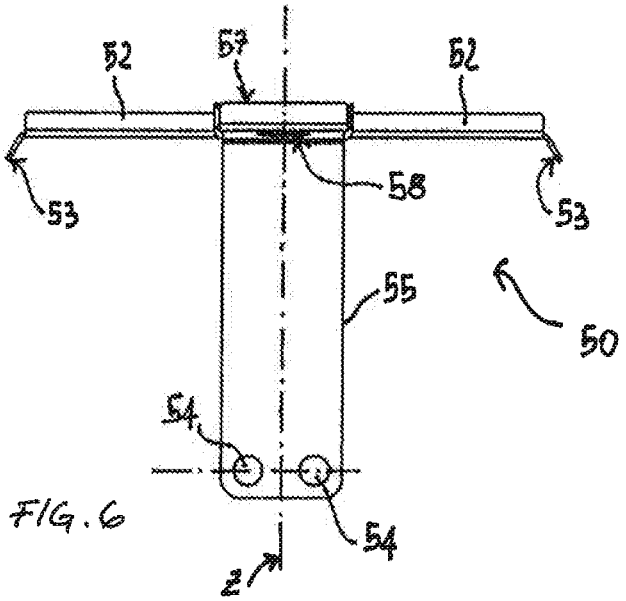
FIG. 6 is a front view of the lubricant collection device in FIG. 5.
Figure 7:
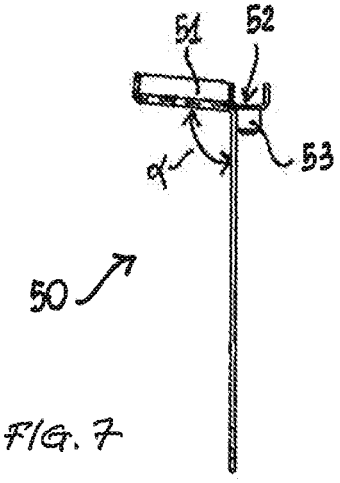
FIG. 7 is a side view of the lubricant collection device in FIG. 5.

With reference to the accompanying drawings and in particular to the embodiment details shown in FIGS. 5 to 7, compressor 100 according to the invention comprises, in the top portion 66 of the head volume 60, a container 51 for collecting the lubricant moved by the oil distribution disc 1, generically according to trajectory A or B. Container 51 is arranged at a higher level with respect to the lubrication opening 82 of the lubrication ducts 81. Such a level or height is considered with respect to the resting surface 31.

Moreover, compressor 100 according to the invention comprises two lubricant distribution channels 52, each of which extends from container 51 so that the lubricating oil, flowing along the distribution channel 52 itself, may reach the lubrication opening 82 of the lubrication ducts 81.

According to a preferred embodiment shown in the drawings, each lubricant distribution channel 52 extends from the collecting container 51 up to a free end 53 arranged so that during operation, the free end 53 and the lubrication opening 82 are aligned along a vertical direction Z and said lubrication opening 82. The latter is arranged at a lower level with respect to said free end 53 (see for example FIGS. 1 and 3).

In particular, container 51 is arranged so as to intercept both the trajectories A and B of the lubricant at low speeds and collect the lubricant to be sent, by means of the two distribution channels 52, towards each lubrication opening 82 of a respective lubrication duct 81.

Preferably, the collecting container 51 comprises a first inlet 57 facing the top 32 of compressor 100 for collecting the lubricant that follows trajectory A when the oil distribution disc 1 rotates according to the clockwise direction. The collecting container 51 further comprises a second inlet 58 facing the resting base 31 of compressor 100 for collecting the lubricant that follows trajectory B when the oil distribution disc 1 rotates according to the anticlockwise direction. The first inlet 57 and the second inlet 58 are spaced apart from each other along a vertical direction Z during operation.

The same lubricant collection and distribution system also allows the preset target to be achieved when the oil distribution disc 1 is restrained to the other lobe rotor 80" (variant not shown in the accompanying drawings). In such a variant, the first inlet 57 facing the top 32 of compressor 100 collects the lubricant when the oil distribution disc 1 rotates according to the anticlockwise direction in FIG. 3, and the second inlet 58 facing the resting base 31 of compressor 100 collects the lubricant when the oil distribution disc 1 rotates according to the clockwise direction in FIG. 3.

As shown in FIGS. 5 to 7, the collecting container 51 preferably is shaped like a collecting drip tray having an upper side that is completely open and coinciding with the first inlet 57 and an opposed lower bottom side 51*a* comprising a middle hole coinciding with the second inlet 58. Container 51 further comprises a side edge 51*b* for containing the lubricant collected in container 51. The side edge 51*b* has an open side towards the distribution channels 52 to allow the outflow of the lubricant towards the free end 53 and the lubrication opening 82.

The lubricant reaches the lubrication opening 82 from end 53 by falling due to gravity. End 53 is shaped like a tilted tab with respect to the respective distribution channels 52 to facilitate the outflow of the lubricant towards the lubrication opening 82 of the respective lubrication duct 81. The distribution channels 52 are arranged parallel to the resting base 31 so as to be arranged almost horizontally, when the resting base 31 is also arranged horizontally. Alternatively, the distribution channels 52 may be slightly tilted so as to facilitate the outflow of the lubricant towards the respective end 53.

According to a preferred embodiment shown in the drawings, the collecting container 51 is fastened to at least one of the mounting flanges of the rolling bearings 90 by means of a supporting plate 55 firmly coupled to the container 51. The supporting plate 55 and container 51 are welded to each other or more preferably, are made by folding from a same metal sheet. The coupling between the supporting plate 55 of container 51 is performed so that lower bottom side 51*a* is tilted with respect to support 55 by an angle $\alpha$ greater than 90° so as to facilitate the outflow of the lubricant from container 51 towards the distribution channels 52 and accordingly, towards the lubrication ducts 81.

The fastening of the supporting plate 55 occurs by means of two screws 59 coupled with respective through holes 54 provided on the supporting plate 55 and with two threaded blind holes provided on each first bushing 21, respectively, of each mounting flange of the rolling bearings 90 provided in the head volume 60. Alternatively (according to another variant not depicted), the supporting plate 55 may be connected on each second bushing 22 of each mounting flange of the rolling bearings 90 provided in the head volume 60. Alternatively (according to another variant not depicted), the supporting plate 55 may be connected only to one of the mounting flanges of the rolling bearings 90 provided in the head volume 60 or directly to a surface of the first head 61.

The connection of the supporting plate 55 to one or both the mounting flanges of the rolling bearings 90 is advantageous because it does not modify the structure of the heads 61, 62, which are obtained by fusion. Accordingly, the present invention may be adapted also to the first head 61 of an existing compressor by possibly modifying only one or both the first bushings 21 or one or both the second bushings 22.

The collecting container 51, the distribution channels 52, including the free ends 53, and the supporting plate 55 form an individually-manipulable assembly that defines a lubricant collection device 50, which as indicated above, may be coupled to a head 61, 62 of an existing volumetric compressor.

When it is restrained to the respective head 61, 62, the lubricant collection device 50 of the accompanying FIGS. 5 to 7 is symmetrical with respect to a longitudinal plane ZZ, which is orthogonal to the resting base 31 and parallel and equally spaced from the rotation axes Y1, Y2. When the resting base 31 is arranged horizontally, the longitudinal plane ZZ is arranged vertically, during operation.

Alternatively (according to other variants not depicted), the lubricant collection device 50 may have another shape, in particular when the respective head 61, 62 is not symmetrical with respect to the longitudinal plane ZZ. In all cases, the lubricant collection device 50 preferably includes a container 51 for collecting the lubricant and two channels 52 for distributing lubricant, having the structure and capable of absolving the above-described function.

In a possible alternative embodiment not shown in the drawings but in any case falling within the scope of protection of the present invention, the two distribution channels 52 could each be defined by a groove that extends on the front surface of head 61. Each groove could be directly communicating with a corresponding lubrication duct 81 through the corresponding lubrication opening 82. Container 51 could be communicating with each groove so that the oil collected flows towards the corresponding lubrication duct.

According to a further variant, it also falling within the scope of protection of the present invention, the distribution channels 52 could be partially defined by a first stretch (integral with container 51) that extends from container 51, and partially by a second stretch defined by a groove made in head 61. In these hypothetical embodiment, the fluid collected in the container would first be conveyed through the first stretch in the grooves defined in head 61 and then brought up to the corresponding lubrication openings 82 through the grooves themselves, rather than falling due to gravity into the lubrication opening 82.

The invention claimed is:

1. A volumetric compressor, comprising:

a main hollow body defining an operating chamber for accommodating at least two lobe rotors rotating about respective substantially parallel rotation axes;

a head provided at an end of said body;

a cover fixed to said head so as to define a head volume between said cover and said head, wherein during operation the head volume accommodates a lubricant bath;

at least two rolling bearings, each rolling bearing being interposed between said head and a respective lobe rotor of said at least two lobe rotors to allow rotation of the respective lobe rotor about one of the respective rotation axes;

at least two lubrication ducts, each lubrication duct extending between a lubrication opening in said head volume and a respective rolling bearing of said at least two rolling bearings;

an oil distribution disc accommodated in the head volume and integrally connected to one of said at least two lobe rotors, said oil distribution disc being configured for rotation and, when put into rotation, moving said lubricant bath;

a container for collecting said lubricant moved by said oil distribution disc, said container being arranged at a higher level with respect to said lubrication opening; and at least two lubricant distribution channels, wherein each lubricant distribution channel extends from said collecting container so that said lubricating oil flowing along the same distribution channel reaches said lubrication opening of a corresponding one of said lubrication ducts.

2. The compressor according to claim 1, wherein each distribution channel extends from said container up to a free end arranged so that in use, said free end and said lubrication opening substantially are aligned along a vertical direction and said lubrication opening is arranged at a lower level with respect to said free end.

3. The compressor according to claim 1, wherein said collecting container comprises a first inlet and at least a second inlet for said lubricant moved by said oil distribution disc, said first inlet and said second inlet being spaced apart from each other along a vertical direction.

4. The compressor according to claim 3, wherein the collecting container is arranged with respect to said oil distribution disc so that said first inlet collects said lubricant when said oil distribution disc rotates about the respective rotation axis according to one rotation direction, and said second inlet collects said lubricant when said oil distribution disc rotates about the respective rotation axis according to another rotation direction.

5. The compressor according to claim 3, wherein said collecting container is shaped like a drip tray having an upper side and an opposed lower side comprising the first inlet and the second inlet, respectively, and a side edge open towards said two distribution channels.

6. The compressor according to claim 5, wherein said upper side of said collecting container is completely open and coincides with said first inlet.

7. The compressor according to claim 1, wherein said compressor comprises at least two mounting flanges, each mounting flange fastening one of said rolling bearings to said head, said lubrication duct being defined between said mounting flange and said head.

8. The compressor according to claim 7, wherein said flange comprises:

a first bushing having a first abutment shoulder for a first axial end of said rolling bearing, said first bushing being fastened to said head, said lubrication duct being provided between said mounting flange and said head;

a second abutment bushing for a second axial end of said rolling bearing, said second bushing being fastened to said first bushing.

9. The compressor according to claim 7, wherein said collecting container is fastened to at least one of said two mounting flanges by means of a support portion.

10. The compressor according to claim 9, wherein said collecting container is firmly constrained to said support portion so that said container is tilted with respect to said support portion by an angle which is greater than 90°.

11. A lubricant collection device for a volumetric compressor, comprising:

an oil distribution disc;

a container for collecting a lubricant moved by said oil distribution disc;

at least two distribution channels for conveying said lubricant and extending from opposite sides of said collecting container, each distribution channel extending a length to a respective free end of the distribution channel; and a support portion integral with said container and configured so that said container is tilted with respect to said support by an angle ($\alpha$) which is greater than or equal to 90°.

* * * * *